US011698072B2

(12) United States Patent
Katayama

(10) Patent No.: US 11,698,072 B2
(45) Date of Patent: Jul. 11, 2023

(54) COMPRESSOR

(71) Applicant: DAIKIN INDUSTRIES, LTD., Osaka (JP)

(72) Inventor: Tatsuya Katayama, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/878,248

(22) Filed: Aug. 1, 2022

(65) Prior Publication Data

US 2022/0372983 A1 Nov. 24, 2022

Related U.S. Application Data

(63) Continuation of application No. PCT/JP2021/004972, filed on Feb. 10, 2021.

(30) Foreign Application Priority Data

Feb. 10, 2020 (JP) ..... 2020-020691

(51) Int. Cl.
*F04C 29/06* (2006.01)
*F04C 18/32* (2006.01)

(52) U.S. Cl.
CPC ..... *F04C 29/065* (2013.01); *F04C 18/32* (2013.01)

(58) Field of Classification Search
CPC .... F04C 18/32–336; F04C 23/001–003; F04C 29/06; F04C 29/063–068;
(Continued)

(56) References Cited

U.S. PATENT DOCUMENTS

2002/0051715 A1* 5/2002 Matsumoto ..... H02K 5/24 417/410.3
2008/0085205 A1* 4/2008 Tamaoki ..... F04C 29/068 418/61.1

(Continued)

FOREIGN PATENT DOCUMENTS

JP 62-88897 U 6/1987
JP 10-213087 A 8/1998

(Continued)

OTHER PUBLICATIONS

International Search Report of corresponding PCT Application No. PCT/JP2021/004972 dated Mar. 30, 2021.

(Continued)

*Primary Examiner* — Alexander B Comley
(74) *Attorney, Agent, or Firm* — Global IP Counselors, LLP

(57) ABSTRACT

A compressor includes a drive mechanism and a compression mechanism having a discharge passage and a plurality of members disposed to overlap. The discharge passage includes a muffling chamber, an inflow passage connected to an inflow end of the muffling chamber, and an outflow passage connected to an outflow end of the muffling chamber. The muffling chamber is formed across two or more of the plurality of members. The compression mechanism includes first and second cylinders, and a second closing member that covers an opening surface a of the first cylinder and an opening surface of the second cylinder. The muffling chamber includes an expansion chamber having a passage sectional area larger than the inflow and outflow passages. The expansion chamber is formed across the second closing member, and the first and second cylinders.

2 Claims, 4 Drawing Sheets

(58) Field of Classification Search
CPC ..... F04C 2270/13; F04B 39/0027; F04B 39/0055–0066; F04B 53/001
USPC ..... 417/312, 410.3, 410.4, 540
See application file for complete search history.

(56) References Cited

U.S. PATENT DOCUMENTS

| | | | | |
|---|---|---|---|---|
| 2011/0023535 | A1* | 2/2011 | Morimoto | C09K 5/045 62/510 |
| 2014/0250937 | A1* | 9/2014 | Hirayama | F04C 29/065 418/60 |
| 2019/0195228 | A1 | 6/2019 | Lee | |

FOREIGN PATENT DOCUMENTS

| | | | | |
|---|---|---|---|---|
| JP | 10213087 | A | * | 8/1998 |
| JP | 2006-161750 | A | | 6/2006 |
| JP | 2012-167584 | A | | 9/2012 |
| JP | 2012167584 | A | * | 9/2012 |

OTHER PUBLICATIONS

International Preliminary Report of corresponding PCT Application No. PCT/JP2021/004972 dated Aug. 25, 2022.
European Search Report of corresponding EP Application No. 21 75 4180.4 dated Dec. 15, 2022.

* cited by examiner

COMPRESSOR

CROSS-REFERENCE TO RELATED APPLICATIONS

This is a continuation of International Application No. PCT/JP2021/004972 filed on Feb. 10, 2021, which claims priority to Japanese Patent Application No. 2020-020691, filed on Feb. 10, 2020. The entire disclosures of these applications are incorporated by reference herein.

BACKGROUND

Technical Field

The present disclosure relates to a compressor.

Background Art

Compressors that are used in refrigeration apparatuses, such as air conditioning apparatuses, are known in the art. Japanese Unexamined Patent Application Publication No. 2012-167584 discloses a full-hermetic compressor. In this compressor, a compression mechanism portion (compression mechanism) and an electric motor portion (electric motor) are housed in an airtight container (casing). The compression mechanism portion includes two cylinders, an intermediate partition plate (intermediate plate) that partitions the two cylinders, two bearing portions (a front head and a rear head) that close open ends of the two cylinders, and two valve covers fitted into respective bearing portions. The compression mechanism portion has a communication hole (discharge passage) that causes the intermediate partition plate of the two cylinders to be in communication with the two beating portions. The communication hole guides a refrigerant gas discharged into one of the valve covers into the other of the valve covers. The diameter of the communication hole formed in the intermediate partition plate or the cylinders is larger than the diameter of the communication hole formed in the other components. Consequently, noise generated in the compression mechanism portion is reduced.

SUMMARY

A first aspect of the present disclosure is directed to a compressor including a drive mechanism, and a compression mechanism configured to be driven by the drive mechanism. The compression mechanism has a discharge passage in which a refrigerant compressed in the compression mechanism flows, and a plurality of members disposed to overlap each other. The discharge passage includes a muffling chamber, an inflow passage connected to an inflow end of the muffling chamber, and an outflow passage connected to an outflow end of the muffling chamber. The muffling chamber is formed across two or more members of the plurality of members. The compression mechanism includes a first cylinder, a second cylinder, and an intermediate closing member. The intermediate closing member covers an opening surface at a second end in an axial direction of the first cylinder, and an opening surface at a first end in an axial direction of the second cylinder. The inflow passage, the muffling chamber, and the outflow passage are formed to be continuous with each other in a direction in which the plurality of members overlap each other. The muffling chamber includes an expansion chamber having a passage sectional area larger than passage sectional areas of the inflow passage and the outflow passage. The expansion chamber is formed across the intermediate closing member, the first cylinder, and the second cylinder. The intermediate closing member has a hole that passes through the intermediate closing member in an axial direction. The first cylinder has a first recessed portion formed at an end surface of the first cylinder on a side of the second end in the axial direction, the first recessed portion being in communication with the hole of the intermediate closing member, and a first hole in communication with the first recessed portion and the outflow passage. The second cylinder has a second recessed portion formed at an end surface of the second cylinder on a side of the first end in the axial direction, the second recessed portion being in communication with the hole of the intermediate closing member, and a second hole in communication with the second recessed portion and the inflow passage. The expansion chamber is formed by the hole of the intermediate closing member, an internal space of the first recessed portion, and an internal space of the second recessed portion. The hole of the intermediate closing member, the first recessed portion, and the second recessed portion have diameters that are identical to each other. The inflow passage, the outflow passage, the first hole of the first cylinder, the second hole of the second cylinder, and the expansion chamber are formed to be coaxial with each other.

DETAILED DESCRIPTION OF EMBODIMENT(S)

A first embodiment will be described. A shell-and-plate heat exchanger (1) (which will be hereinafter referred to as a "heat exchanger") of this embodiment is a condenser. The heat exchanger (1) of this embodiment is provided in a refrigerant circuit of a refrigeration apparatus that performs a refrigeration cycle, and heats a heating medium with a refrigerant. Examples of the heating medium include water and brine.

Embodiment 1

Embodiment 1 will be described. A compressor (1) of the present embodiment is a rotary compressor of a so-called swing piston type. The compressor (1) is provided in a refrigerant circuit that performs a vapor compression refrigeration cycle, and sucks and compresses a refrigerant that has evaporated in an evaporator.

Overall Configuration of Compressor

Figure 1:
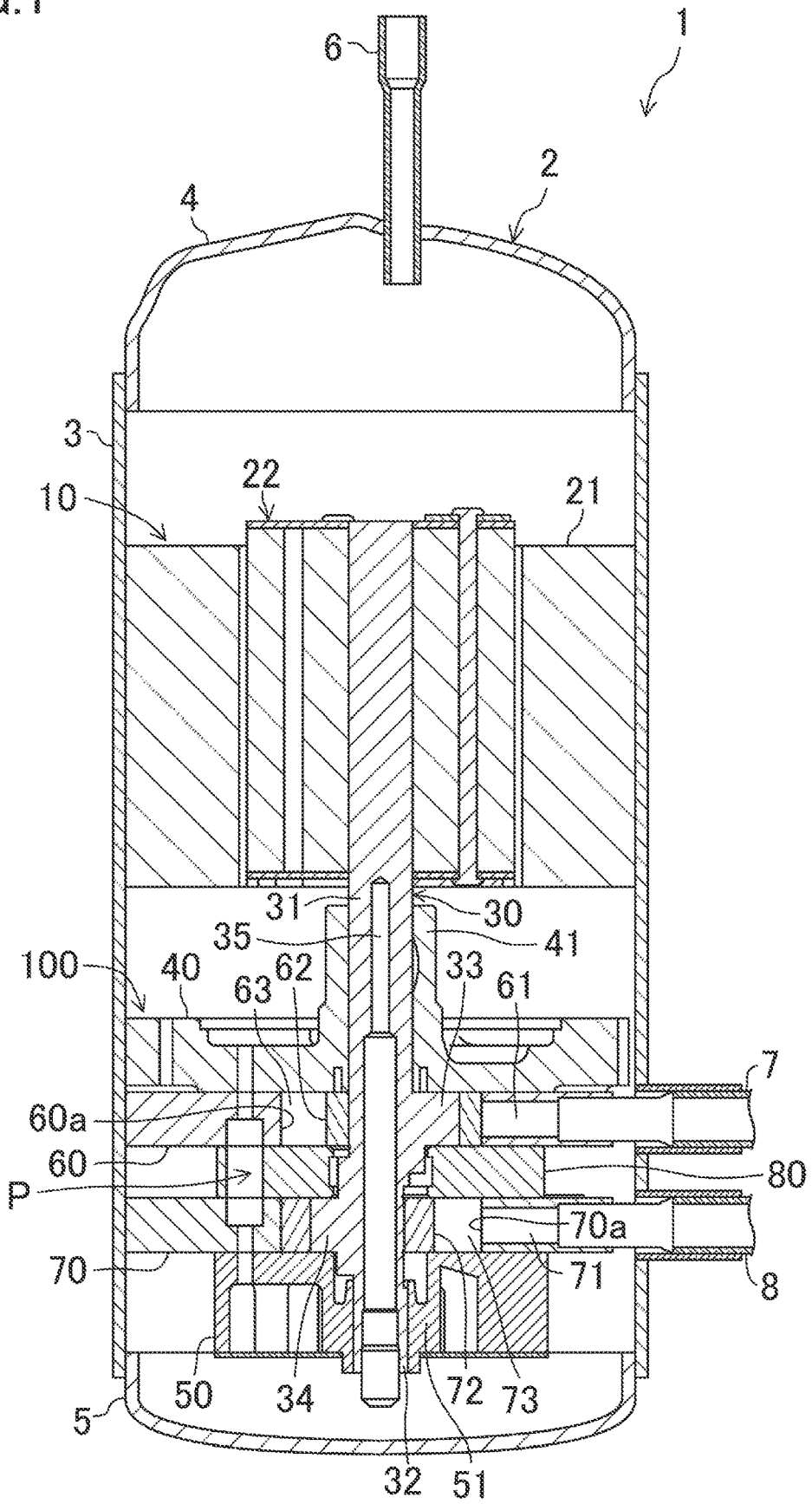
FIG. 1 is a longitudinal sectional view illustrating a configuration of a compressor according to Embodiment 1.

As illustrated in FIG. 1, the compressor (1) of the present embodiment is a fully hermetic compressor. The compressor (1) includes a compression mechanism (100) and a drive mechanism (10). In the compressor (1), the compression mechanism (100) and the drive mechanism (10) are housed in a casing (2). The drive mechanism (10) is constituted by an electric motor (20) and a drive shaft (30).

Casing

The casing (2) is a cylindrical airtight container in a standing state. The casing (2) includes a cylindrical body portion (3), and a pair of panels (4, 5) that close end portions of the body portion (3). Suction pipes (7, 8) are each attached to a lower portion of the body portion (3). The suction pipes (7, 8) pass through the body portion (3) of the casing (2) and are connected to the compression mechanism (100). A discharge pipe (6) is attached to the panel (4) on the upper side. The discharge pipe (6) passes through a top portion of the casing (2) and opens in the internal space of the casing (2).

Electric Motor

The electric motor (20) is disposed in an upper portion of the internal space of the casing (2). The electric motor (20) includes a stator (21) and a rotor (22). The stator (21) is fixed to the body portion (3) of the casing (2). The drive shaft (30), which will be described later, is inserted into the rotor (22).

Drive Shaft

The drive shaft (30) extends from an upper portion of the body portion (3) of the casing (2) to a bottom portion of the casing (2) in the axial direction (up-down direction) of the casing (2). The drive shaft (30) is rotatably driven by the electric motor (20). The drive shaft (30) includes a main shaft portion (31), a sub-shaft portion (32), an upper eccentric portion (33), and a lower eccentric portion (34). In the drive shaft (30), the main shaft portion (31), the upper eccentric portion (33), the lower eccentric portion (34), and the sub-shaft portion (32) are disposed in this order from top to bottom. In the drive shaft (30), the main shaft portion (31), the upper eccentric portion (33), the lower eccentric portion (34), and the sub-shaft portion (32) are integral with each other.

The main shaft portion (31) and the sub-shaft portion (32) each have a columnar shape and are disposed coaxially with each other. The rotor (22) of the electric motor (20) is attached to an upper portion of the main shaft portion (31). A lower portion of the main shaft portion (31) is inserted into a main bearing portion (41) of a front head (40), which will be described later. The sub-shaft portion (32) is inserted into a sub-bearing portion (51) of a rear head (50), which will be described later. The main shaft portion (31) of the drive shaft (30) is supported by the main bearing portion (41), and the sub-shaft portion (32) of the drive shaft (30) is supported by the sub-bearing portion (51).

The upper eccentric portion (33) and the lower eccentric portion (34) each have a columnar shape having a diameter larger than the diameters of the main shaft portion (31) and the sub-shaft portion (32). The center axis of each of the upper eccentric portion (33) and the lower eccentric portion (34) is parallel to the rotational center axis of the main shaft portion (31) and the sub-shaft portion (32). The center axis of each of the upper eccentric portion (33) and the lower eccentric portion (34) is eccentric to the main shaft portion (31) and the sub-shaft portion (32). The upper eccentric portion (33) is eccentric to the rotational center axis of the drive shaft (30) toward a side opposite to the lower eccentric portion (34).

The upper eccentric portion (33) is inserted into an upper piston (62). The upper eccentric portion (33) supports the upper piston (62). The lower eccentric portion (34) is inserted into a lower piston (72). The lower eccentric portion (34) supports the lower piston (72).

An oil supply passage (35) is formed in the drive shaft (30). A lubricating oil (refrigerating-machine oil) that has accumulated at a bottom portion of the casing (2) is supplied to a bearing of the drive shaft (30) and a sliding part of the compression mechanism (100) through the oil supply passage (35).

Compression Mechanism

The compression mechanism (100) is a rotary compression mechanism of a so-called swing piston type. The compression mechanism (100) is driven by the drive mechanism (10). In the internal space of the casing (2), the compression mechanism (100) is disposed below the electric motor (20).

Compression Mechanism

The compression mechanism (100) is a two-cylinder rotary compression mechanism. The compression mechanism (100) includes one each of the front head (40), the rear head (50), and an intermediate plate (80). The compression mechanism (100) includes two each of the cylinders (60, 70) and the pistons (62, 72).

In the compression mechanism (100), the rear head (50), a lower cylinder (70), the intermediate plate (80), an upper cylinder (60), and the front head (40) are disposed in this order from bottom to top in a state of overlapping each other. In other words, in the compression mechanism (100), a plurality of members are disposed to overlap each other. The rear head (50), the lower cylinder (70), the intermediate plate (80), the upper cylinder (60), and the front head (40) are fastened to each other by a plurality of bolts (not illustrated). The front head (40) of the compression mechanism (100) is fixed to the body portion (3) of the casing (2).

In the present embodiment, the upper cylinder (60), the lower cylinder (70), the front head (40), the rear head (50), and the intermediate plate (80) correspond to the plurality of members.

Upper Cylinder, Lower Cylinder, Upper Piston, Lower Piston

Each of the cylinders (60, 70) is a thick disk-shaped member. Each of the cylinders (60, 70) has a cylinder bore (60*a*, 70*a*) and a suction port (61, 71). The upper cylinder (60) and the lower cylinder (70) have the same thickness.

The cylinder bore (60*a*, 70*a*) is formed at the center of each of the cylinders (60, 70). The upper piston (62) that has a thick cylindrical shape is disposed in the cylinder bore (60*a*) on the upper side. The lower piston (72) that has a thick cylindrical shape is disposed in the cylinder bore (70*a*) on the lower side. The upper eccentric portion (33) of the drive shaft (30) is inserted into the upper piston (62). The lower eccentric portion (34) of the drive shaft (30) is inserted into the lower piston (72). In the compression mechanism (100), a compression chamber (63, 73) is formed between the wall surface of each of the cylinder bores (60*a*, 70*a*) and the outer peripheral surface of each of the pistons (62, 72). The compression mechanism (100) is provided with a blade (not illustrated) that partitions the compression chamber (63, 73) into a high-pressure chamber and a low-pressure chamber.

The suction port (61, 71) is a hole that extends from the wall surface of the cylinder bore (60*a*, 70*a*) toward the radially outer side of the cylinder (60, 70) and that has a circular section. The suction port (61, 71) opens in the outside surface of the cylinder (60, 70). The suction pipe (7) on the upper side is inserted into the suction port (61, 71) of the upper cylinder (60). The suction pipe (8) on the lower side is inserted into the suction port (61, 71) of the lower cylinder (70).

Figure 2:
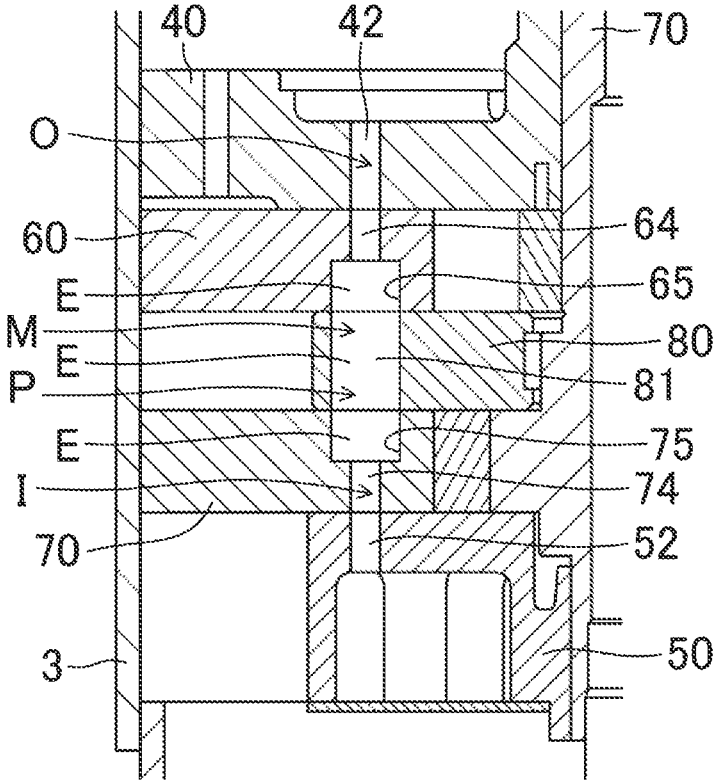
FIG. 2 is an enlarged longitudinal sectional view of a main portion of the compressor.

As illustrated in FIG. 2, a first hole (64) and a first recessed portion (65) are formed in the upper cylinder (60). The first recessed portion (65) and the first hole (64) are formed in the upper cylinder (60) in this order from bottom to top. The internal space of the first recessed portion (65) and the first hole (64) are continuous with each other.

The first hole (64) extends downward from the upper end surface of the upper cylinder (60). The cross-section of the first hole (64) has a circular shape. The diameter of the first hole (64) is constant from the upper end to the lower end. The first recessed portion (65) extends upward from the lower end surface of the upper cylinder (60). The cross-section of the first recessed portion (65) has a circular shape. The inner diameter of the first recessed portion (65) is constant from the upper end to the lower end. The diameter of the first hole (64) is smaller than the inner diameter of the first recessed portion (65). The first hole (64) and the internal space of the first recessed portion (65) are in communication with each other. Specifically, the lower end of the first hole (64) is in communication with the upper-side open end of the first recessed portion (65).

The first hole (64) and the first recessed portion (65) pass through the upper cylinder (60) in the thickness direction (up-down direction). The height of each of the first hole (64) and the first recessed portion (65) in the up-down direction is substantially ½ of the thickness of the upper cylinder (60). The upper end of the first hole (64) is in communication with the lower end of a third hole (42) of the later-described front head (40). The lower end of the internal space of the first recessed portion (65) is in communication with the upper end of a fifth hole (81) of the intermediate plate (80), which will be described later.

A second hole (74) and a second recessed portion (75) are formed in the lower cylinder (70). The second recessed portion (75) and the second hole (74) are formed in the lower cylinder (70) in this order from top to bottom. The internal space of the second recessed portion (75) and the second hole (74) are continuous with each other.

The second recessed portion (75) extends downward from the upper end surface of the lower cylinder (70). The cross-section of the second recessed portion (75) has a circular shape. The inner diameter of the second recessed portion (75) is constant from the upper end to the lower end. The second hole (74) extends upward from the lower end surface of the lower cylinder (70). The cross-section of the second hole (74) has a circular shape. The diameter of the second hole (74) is constant from the upper end to the lower end. The diameter of the second hole (74) is smaller than the inner diameter of the second recessed portion (75).

The second hole (74) and the internal space of the second recessed portion (75) are in communication with each other. Specifically, the lower-side open end of the second recessed portion (75) is in communication with the upper end of the second hole (74). The second hole (74) and the second recessed portion (75) pass through the lower cylinder (70) in the thickness direction (up-down direction). The height of each of the second hole (74) and the second recessed portion (75) in the up-down direction is substantially ½ of the thickness of the lower cylinder (70). The upper end of the internal space of the second recessed portion (75) is in communication with the lower end of the fifth hole (81) of the intermediate plate (80). The lower end of the second hole (74) is in communication with the upper end of a fourth hole (52) of the rear head (50), which will be described later.

In the present embodiment, the upper cylinder (60) corresponds to the first cylinder, and the lower cylinder (70) corresponds to the second cylinder.

Front Head, Rear Head

The front head (40) is a plate-shaped member that covers an opening surface at the upper end (one end in the axial direction) of the upper cylinder (60). At a center portion of the front head (40), the main bearing portion (41) that has a cylindrical shape is formed. A bearing metal (not illustrated) is fitted into the main bearing portion (41). The main bearing portion (41) including the bearing metal is a slide bearing that supports the main shaft portion (31) of the drive shaft (30).

The third hole (42) is formed in the front head (40). The third hole (42) passes through the front head (40) in the thickness direction (up-down direction). The upper end of the third hole (42) opens in the internal space of the casing (2). The lower end of the third hole (42) is in communication with the first hole (64) of the upper cylinder (60). The diameter of the third hole (42) is equal to the diameter of the first hole (64).

The rear head (50) is a plate-shaped member that covers an opening surface at the lower end (the other end in the axial direction) of the lower cylinder (70). At a center portion of the rear head (50), the sub-bearing portion (51) that has a cylindrical shape is formed. A bearing metal (not illustrated) is fitted into the sub-bearing portion (51). The sub-bearing portion (51) including the bearing metal is a slide bearing thaw supports the sub-shaft portion (32) of the drive shaft (30).

The fourth hole (52) is formed in the rear head (50). The fourth hole (52) passes through the rear head (50) in the thickness direction (up-down direction). The upper end of the fourth hole (52) is in communication with the second hole (74) of the lower cylinder (70). The lower end of the fourth hole (52) is in communication with a lower compression chamber (73) via a space formed on the lower side of the fourth hole (52). The diameter of the fourth hole (52) is equal to the diameter of the second hole (74).

In the present embodiment, the front head (40) corresponds to the first closing member, and the rear head (50) corresponds to the second closing member.

Intermediate Plate

The intermediate plate (80) is a disk-shaped member. The intermediate plate (80) covers an opening surface at the lower end (the other end in the axial direction) of the upper cylinder and an opening surface at the upper end (one end in the axial direction) of the lower cylinder. A through hole for inserting the drive shaft (30) therethrough is formed at a center portion of the intermediate plate (80).

The fifth hole (81) is formed in the intermediate plate (80). The fifth hole (81) passes through the intermediate plate (80) in the thickness direction (up-down direction), The upper end of the fifth hole (81) is in communication with the internal space of the first recessed portion (65) of the upper cylinder (60). The lower end of the fifth hole (81) is in communication with the internal space of the second recessed portion (75) of the lower cylinder (70). The diameter of the fifth hole (81) is equal to the inner diameters of the first recessed portion (65) and the second recessed portion (75). In the present embodiment, the intermediate plate (80) corresponds to the intermediate closing member.

Discharge Passage

As illustrated in FIG. 2, a discharge passage (P) is formed in the compression mechanism (100). The discharge passage (P) is a passage for discharging a refrigerant compressed in the compression chamber (63, 73) of the lower cylinder (70)

to an upper space of the compression mechanism (100). The discharge passage (P) includes a muffling chamber (M), an inflow passage (I), and an outflow passage (O). The inflow passage (I), the muffling chamber (M), and the outflow passage (O) are disposed in this order from bottom to top. The inflow passage (I), the muffling chamber (M), and the outflow passage (O) are formed to be continuous with each other in the up-down direction (the direction in which the plurality of members overlap each other).

The inflow passage (I) is constituted by the fourth hole (52) of the rear head (50) and the second hole (74) of the lower cylinder (70). In other words, the inflow passage (I) is formed across the two members of the rear head (50) and the lower cylinder (70).

The muffling chamber (M) is constituted by the internal space of the second recessed portion (75) of the lower cylinder (70), the fifth hole (81) of the intermediate plate (80), and the internal space of the first recessed portion (65) of the upper cylinder (60). In other words, the muffling chamber (M) is formed across three members. The muffling chamber (M) includes a plurality of expansion chambers (E). The expansion chambers (E) are the internal space of the second recessed portion (75) of the lower cylinder (70), the fifth hole (81) of the intermediate plate (80), and the internal space of the first recessed portion (65) of the upper cylinder (60). In other words, the expansion chamber (E) is formed in each of the upper cylinder (60), the intermediate plate (80), and the lower cylinder (70).

In the present embodiment, the upper cylinder (60) the intermediate plate (80), and the lower cylinder (70) correspond to the first member. In the present embodiment, upper cylinder (60) and the lower cylinder (70) correspond to the third member.

The outflow passage (O) is constituted by the first hole (64) of the upper cylinder (60) and the third hole (42) of the front head (40). In other words, the outflow passage (O) is formed across the two members of the upper cylinder (60) and the front head (40).

The outflow end of the inflow passage (I) is in communication with the inflow end of the muffling chamber (M). In other words, the outflow end of the inflow passage (I) is in communication with the inflow end of the internal space of the second recessed portion (75) of the lower cylinder (70). The inflow end of the outflow passage (O) is in communication with the outflow end of the muffling chamber (M). In other words, the inflow end of the outflow passage (O) is in communication with the outflow end of the internal space of the first recessed portion (65) of the upper cylinder (60). The internal spaces of the first recessed portion (65) and the second recessed portion (75) constitute part of the muffling chamber (M). The inflow passage (I), the muffling chamber (M), and the outflow passage (O) are disposed coaxially.

The passage sectional area of the expansion chambers (E) is larger than the passage sectional areas of the inflow passage (I) and the outflow passage (O). Specifically, the passage sectional area of each of the second recessed portion (75) of the lower cylinder (70), the fifth hole (81) of the intermediate plate (80), and the first recessed portion (65) of the upper cylinder (60) is larger than the flow-path sectional area of each of the fourth hole (52) of the rear head (50) and the second hole (74) of the lower cylinder (70). The passage sectional area of each of the second recessed portion (75) of the lower cylinder (70), the fifth hole (81) of the intermediate plate (80), and the first recessed portion (65) of the upper cylinder (60) is larger than the flow-path sectional area of each of the third hole (42) of the front head (40) and the first hole (64) of the upper cylinder (60).

Operational Action

Next, the operational action of the compressor (1) will be described.

When the electric motor (20) drives the drive shaft (30), each piston (62, 72) of the compression mechanism (100) is driven by the drive shaft (30). Each piston (62, 72) is displaced periodically in the corresponding cylinder (60, 70) every time the drive shaft (30) rotates once. The period of displacement of the upper piston and the period of displacement of the lower piston are shifted from each other by 180° (that is, a half period).

In each cylinder (60, 70), the volumes of the high-pressure chamber and the low-pressure chamber of the compression chamber (63, 73) change in response to the displacement of the piston (62, 72). Each cylinder (60, 70) sucks a refrigerant through the suction port (61, 71) into the compression chamber (63, 73) and compresses the sucked refrigerant. The compressed refrigerant is discharged to the outside of the compression chamber through a discharge port (not illustrated) or the discharge passage (P). The refrigerant compressed in an upper compression chamber (63) of the upper cylinder (60) is discharged to a space above the front head (40) through a discharge port of the front head (40).

The refrigerant compressed in the lower compression chamber (73) of the lower cylinder (70) flows into the fourth hole (52) through a discharge port of the rear head (50) via a space formed in a lower portion of the rear head (50). The refrigerant that has flowed into the fourth hole (52) flows from bottom to top in the order of the second hole (74) of the lower cylinder (70), the internal space of the second recessed portion (75), the fifth hole (81) of the intermediate plate (80), the internal space of the first recessed portion (65) of the upper cylinder (60), the first hole, and the third hole (42) of the front head (40). In other words, the refrigerant compressed in the lower compression chamber (73) flows from bottom to top in the discharge passage (P) formed in the compression mechanism (100) in the order of the inflow passage (I), the muffling chamber (M), and the outflow passage (O).

The refrigerant that has flowed into the third hole (42) of the front head (40) is discharged to a space above the front head (40). The refrigerant discharged from the compression mechanism (100) to the internal space of the casing (2) flows out to the outside of the casing (2) through the discharge pipe (6).

Noise Reduction Effect by Muffling Chamber

The passage sectional area of the expansion chambers (E) included in the muffling chamber (M) is larger than the passage sectional areas of the inflow passage (I) and the outflow passage (O). The refrigerant that has passed through the inflow passage (I) and flowed into the expansion chambers (E) expands in the expansion chambers (E), and the speed and the pressure of the refrigerant decrease. In response to this, the sound energy of the refrigerant also decreases. The refrigerant whose sound energy has been decreased by this expansion passes through the discharge passage (P) by an amount corresponding to the passage sectional area of the outflow passage (O).

The remaining sound energy is attenuated by reflection in the discharge passage (P). Specifically, this reflection easily occurs at the inflow/outflow ends of the expansion chambers (E) and the outflow end of the outflow passage (O). Due to this reflection, interference of sound waves occurs in the discharge passage (P) or the expansion chambers (E), and the sound energy is consumed. Consequently, the sound energy is attenuated in the discharge passage (P), and noise is reduced.

Figure 3:
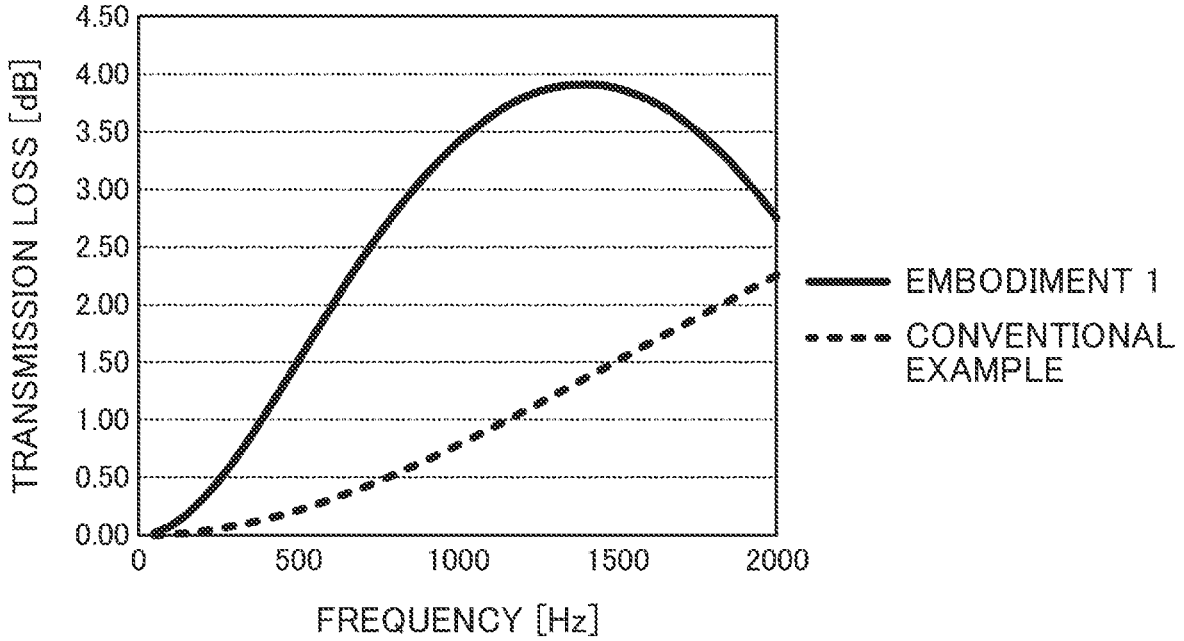
FIG. 3 is a graph showing a relation between the frequency and the transmission loss in a discharge passage.

FIG. 3 is a graph showing a relation between the frequency and the transmission loss in the discharge passage (P), the relation being obtained from simulation. Here, the transmission loss is a difference between the intensity of a sound that has entered a certain object and the intensity of the sound that has transmitted through the certain object. It can be said that the larger the numerical value of the transmission loss is, the more the intensity of the sound is attenuated.

The solid line in FIG. 3 indicates a relation between the frequency and the transmission loss in the discharge passage (P) of the present embodiment. The dotted line in FIG. 3 indicates a relation between the frequency and the transmission loss in a conventional discharge passage. The length of the muffling chamber (M) of the present embodiment in FIG. 3 in the up-down direction is three times the length of the conventional muffling chamber in the up-down direction. Conditions other than the length of the muffling chamber (M) in the up-down direction in FIG. 3 are all identical between the discharge passage (P) of the present embodiment and the conventional discharge passage (P).

It has been confirmed that, in a region of 2 kHz or less in FIG. 3, the transmission loss in the discharge passage (P) is larger than the transmission loss in the conventional discharge passage. In other words, it has been confirmed that the sound generated in the discharge passage (P) is smaller than the sound generated in the conventional discharge passage.

In the discharge passage (P) of the compressor (1), a sound of 1 kHz or less is easily heard as noise. In the discharge passage of a conventional example, the transmission loss of the sound of 1 kHz or less is small, and it is not possible to sufficiently reduce noise. In contrast, in the present embodiment, the transmission loss of the sound of 1 kHz or less is large, and it is thus possible to effectively suppress generation of noise in the discharge passage (P).

Feature (1) of Embodiment 1

The compressor (1) of the present embodiment includes the drive mechanism (10) and the compression mechanism (100) that is driven by the drive mechanism (10). The compression mechanism (100) has the discharge passage (P) in which a refrigerant compressed in the compression mechanism (100) flows, and the plurality of members (40, 50, 60, 70, 80) disposed to overlap each other. The discharge passage (P) includes the muffling chamber (M), the inflow passage (I) connected to the inflow end of the muffling chamber (M), and the outflow passage (O) connected to the outflow end of the muffling chamber (M). The muffling chamber (M) is formed across two or more members of the plurality of members (40, 50, 60, 70, 80).

In the compressor (1) of the present embodiment, the muffling chamber (M) is formed across two or more members. Consequently, it is possible to form the space of the muffling chamber (M) to be large compared with when the muffling chamber (M) is formed in one member. According to the present embodiment, it is possible to improve the effect of reducing the noise generated in the compression mechanism (100).

Feature (2) of Embodiment 1

The inflow passage (I), the muffling chamber (M), and the outflow passage (O) in the compressor (1) of the present embodiment are formed to be continuous with each other in the up-down direction in which the plurality of members (40, 50, 60, 70, 80) overlap each other. The plurality of members (40, 50, 60, 70, 80) include the upper cylinder (60), the lower cylinder (70), and the intermediate plate (80) in each of which the expansion the expansion chamber (E) is formed. The passage sectional area of the expansion chambers (E) is larger than the passage sectional areas of the inflow passage (I) and the outflow passage (O). The muffling chamber (M) is formed across the upper cylinder (60), the lower cylinder (70), and the intermediate plate (80) to include the plurality of expansion chambers (E).

In the compressor (1) of the present embodiment, since the muffling chamber (M) is formed across the upper cylinder (60), the intermediate plate (80), and the lower cylinder (70), it is possible to form the muffling chamber (M) to be large in the up-down direction.

Since the muffling chamber (M) can be formed across the plurality of members, it is possible to increase flexibility in designing the length of the muffling chamber (M) in the up-down direction. As a result, it is possible to reduce noise in a desired frequency range. Specifically, in the compressor (1), the sound of 1 kHz or less easily becomes noise due to the pulsation of the refrigerant being discharged. By increasing the length of the muffling chamber (M) in the up-down direction, it is possible to increase the transmission loss of the sound of 1 kHz or less. In other words, it is possible to effectively reduce noise caused by discharge pulsation of the compressor (1).

Feature (3) of Embodiment 1

The muffling chamber (M) of the compressor (1) of the present embodiment is formed across three or more of the plurality of members (40, 50, 60, 70, 80).

In the compressor (1) of the present embodiment, since the muffling chamber (M) is formed across three or more members, it is possible to form the muffling chamber (M) to be large in the up-down direction.

Feature (4) of Embodiment 1

The plurality of members (40, 50, 60, 70, 80) of the compressor (1) of the present embodiment include the upper cylinder (60) and the lower cylinder (70). The upper cylinder (60) and the lower cylinder (70) have recessed portions (65, 75, 69*a*, 69*b*, 79*a*, 79*b*) that are formed at an end surface in a direction in which the plurality of members overlap each other and that are in communication with the inflow passage (I) or the outflow passage (O). The internal spaces of the recessed portions (65, 75, 69*a*, 69*b*, 79*a*, 79*b*) constitute part of the muffling chamber (M).

In the compressor (1) of the present embodiment, part of the muffling chamber (M) is constituted by the internal spaces of the first recessed portion (65) and the second recessed portion (75). According to the present embodiment, it is easy to machine the expansion chambers (E) in the upper cylinder (60) and the lower cylinder (70).

Feature (5) of Embodiment 1

The plurality of members (40, 50, 60, 70, 80) of the compressor (1) of the present embodiment include the upper cylinder (60), the lower cylinder (70), the front head (40) that covers the opening surface at the upper end of the upper cylinder (60), the intermediate plate (80) that covers the opening surface at the lower end of the upper cylinder (60)

and the opening surface at the upper end of the lower cylinder (70), and the rear head (50) that covers the opening surface at the lower end of the lower cylinder (70).

In the present embodiment, it is possible to improve the effect of reducing noise that is generated in the compressor (1) that includes the two cylinders (60, 70).

Embodiment 2

Embodiment 2 will be described. The compressor (1) of the present embodiment is the compressor (1) of Embodiment 1 in which the configuration of the upper cylinder (60) in the compression mechanism (100) is changed. Here, regarding the upper cylinder (60) according to the present embodiment, features that differ from those in Embodiment 1 will be described.

Compression Mechanism

Figure 4:
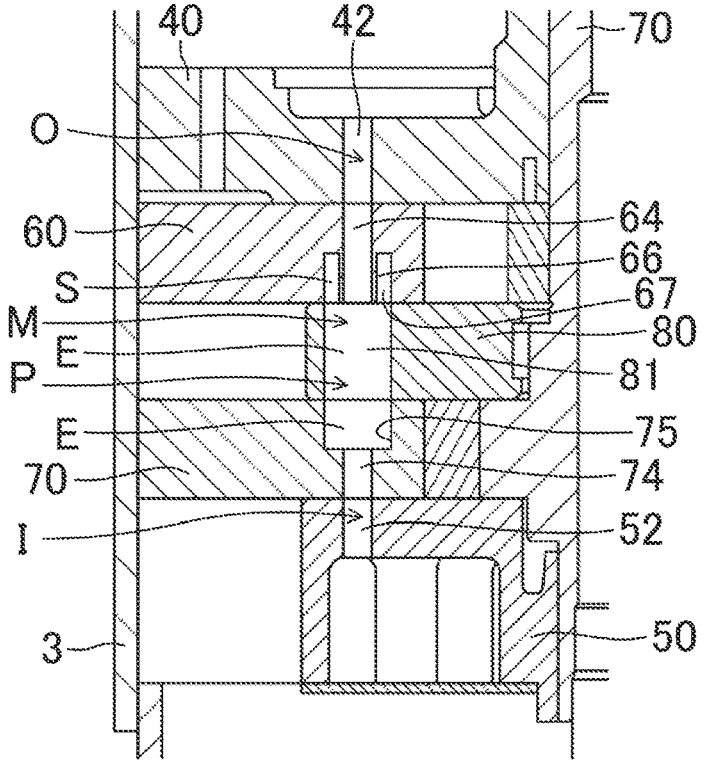
FIG. 4 is a view of a compressor according to Embodiment 2, the view corresponding to FIG. 2.
Figure 5:
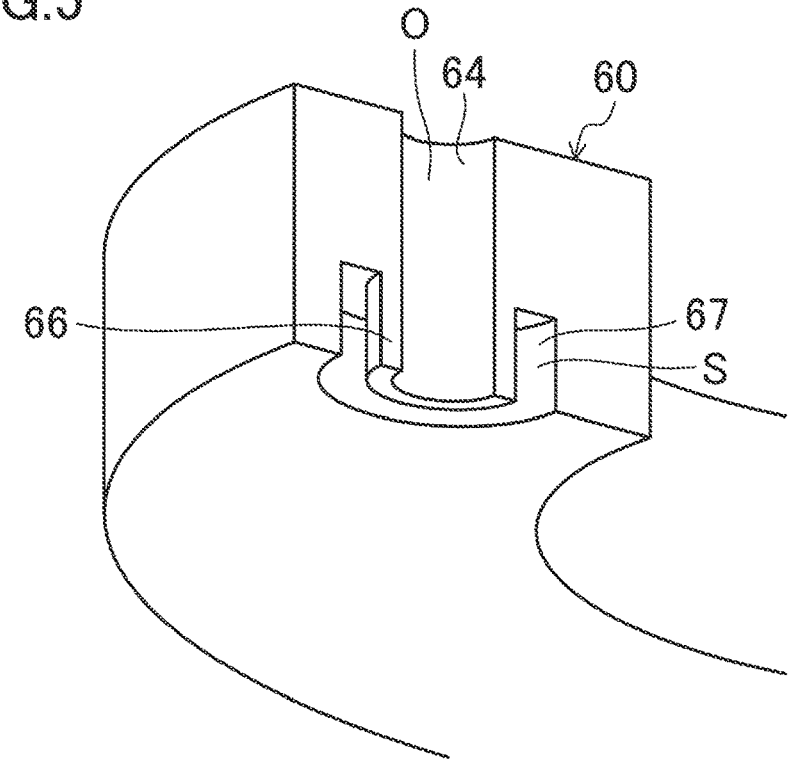
FIG. 5 is an enlarged perspective view of a main portion of an upper cylinder according to Embodiment 2.

As illustrated in FIG. 4 and FIG. 5, the first hole (64) and an annular space (67) are formed in the upper cylinder (60). The first hole (64) extends from the upper end toward the lower end of the upper cylinder (60). The first hole (64) passes through the upper cylinder (60) in the thickness direction (up-down direction). The cross-section of the first hole (64) has a circular shape. The diameter of the first hole (64) is constant from the upper end to the lower end. The diameter of the first hole (64) is equal to the diameter of the third hole (42) of the front head (40) and smaller than the diameter of the fifth hole (81) of the intermediate plate (80). The upper end of the first hole (64) is in communication with the lower end of the third hole (42). The lower end of the first hole (64) is in communication with the upper end of the fifth hole (81).

The annular space (67) is an annular space formed to be coaxial with the first hole (64). The annular space (67) is formed to surround the periphery of the first hole (64). The annular space (67) extends upward from the lower end surface of the upper cylinder (60). The inner diameter of the annular space (67) is larger than the diameter of the first hole (64). The outer diameter of the annular space (67) is equal to the diameter of the fifth hole (81) of the intermediate plate (80). The height of the annular space (67) in the up-down direction is substantially ½ of the thickness of the upper cylinder (60). The lower end of the annular space (67) is in communication with the upper end of the fifth hole (81) of the intermediate plate (80). The upper end of the annular space (67) is closed.

The upper cylinder (60) is provided with a circular pipe portion (66). The first hole (64) is formed on the radially inner side of the circular pipe portion (66). The annular space (67) is formed on the radially outer side of the circular pipe portion (66). In other words, the circular pipe portion (66) demarcates the first hole (64) and the annular space (67) from each other.

The circular pipe portion (66) is formed to be coaxial with the first hole (64). The inner diameter of the circular pipe portion (66) is equal to the diameter of the first hole (64). The outer diameter of the circular pipe portion (66) is smaller than the diameter of the fifth hole (81) of the intermediate plate (80). The circular pipe portion (66) extends downward from the upper cylinder (60) at a position of substantially ½ of the thickness thereof to the lower end surface of the upper cylinder (60). In other words, the length of the circular pipe portion (66) in the up-down direction is substantially ½ of the thickness of the upper cylinder (60). In the present embodiment, the upper cylinder (60) corresponds to the second member.

Discharge Passage

The muffling chamber (M) in the present embodiment is constituted by the internal space of the second recessed portion (75) of the lower cylinder (70), the fifth hole (81) of the intermediate plate (80), and the annular space (67) of the upper cylinder (60). In other words, the muffling chamber (M) is formed across three members. The muffling chamber (M) includes the plurality of expansion chambers (E) and an auxiliary muffling chamber (S). The expansion chambers (E) are the internal space of the second recessed portion (75) of the lower cylinder (70) and the fifth hole (81) of the intermediate plate (80). The auxiliary muffling chamber (S) is the annular space (67) of the upper cylinder (60). In other words, the auxiliary muffling chamber (S) is formed in the upper cylinder (60). The lower end of the auxiliary muffling chamber (S) is in communication with the upper end of the expansion chambers (E).

The outflow passage (O) in the present embodiment is constituted by the first hole (64) of the upper cylinder (60) and the third hole (42) of the front head (40). In other words, the outflow passage (O) is formed across the two members of the upper cylinder (60) and the front head (40). The inflow end of the outflow passage (O) is in communication with the outflow end of the muffling chamber (M). In other words, the inflow end of the outflow passage (O) is in communication with the outflow end of the fifth hole (81) of the intermediate plate (80). The outflow passage (O) and the auxiliary muffling chamber (S) of the muffling chamber (M) are demarcated from each other by the circular pipe portion (66) of the upper cylinder (60).

The passage sectional area of the expansion chambers (E) is larger than the passage sectional areas of the inflow passage (I) and the outflow passage (O). Specifically, the passage sectional area of each of the second recessed portion (75) of the lower cylinder (70) and the fifth hole (81) of the intermediate plate (80) is larger than the flow-path sectional area of each of the fourth hole (52) of the rear head (50) and the second hole (74) of the lower cylinder (70). The passage sectional area of each of the second recessed portion (75) of the lower cylinder (70) and the fifth hole (81) of the intermediate plate (80) is larger than the flow-path sectional area of each of the third hole (42) of the front head (40) and the first hole (64) of the upper cylinder (60).

Feature (1) of Embodiment 2

The plurality of members (40, 50, 60, 70, 80) of the compressor (1) of the present embodiment include the lower cylinder (70) and the intermediate plate (80) in which the expansion chambers (E) are formed, and the upper cylinder (60) in which the auxiliary muffling chamber (S) in communication with the expansion chambers (E) is formed. The muffling chamber (M) is formed across the upper cylinder (60), the lower cylinder (70), and the intermediate plate (80) so as to include the expansion chambers (E) and the auxiliary muffling chamber (S).

In the compressor (1) of the present embodiment, since the muffling chamber (M) includes the auxiliary muffling chamber (S), it is possible to form the muffling chamber (M) to be large in the up-down direction.

Embodiment 3

Embodiment 3 will be described. The compressor (1) of the present embodiment is the compressor (1) of Embodiment 1 in which the configurations of the upper cylinder (60) and the lower cylinder (70) in the compression mechanism (100) are changed. Here, regarding the upper cylinder (60)

and the lower cylinder (70) of the present embodiment, features that differ from those in Embodiment 1 will be described.

Compression Mechanism

Upper Cylinder

Figure 6:
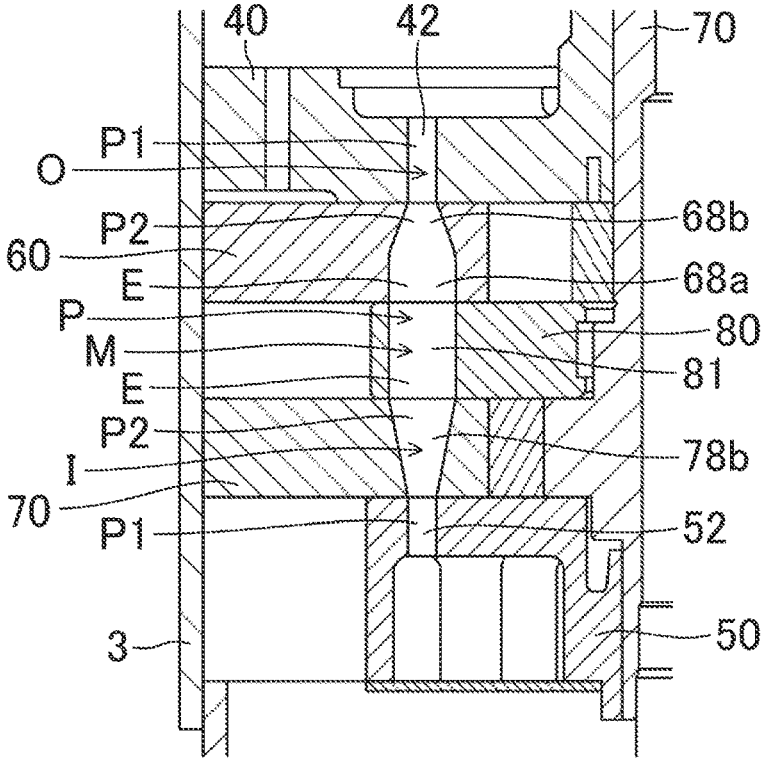
FIG. 6 is a view corresponding to FIG. 2 according to Embodiment 3.

As illustrated in FIG. 6, a first vertical hole (68*a*) and a first inclined hole (68*b*) are formed in the upper cylinder (60). The first vertical hole (68*a*) and the first inclined hole (68*b*) are formed in the upper cylinder (60) in this order from bottom to top. The first vertical hole (68*a*) and the first inclined hole (68*b*) are continuous with each other. Specifically, the upper end of the first vertical hole (68*a*) and the lower end of the first inclined hole (68*b*) are connected to each other. The first vertical hole (68*a*) and the first inclined hole (68*b*) pass through the upper cylinder (60) in the thickness direction (up-down direction).

The first vertical hole (68*a*) extends upward from the lower end surface of the upper cylinder (60). The cross-section of the first vertical hole (68*a*) has a circular shape. The diameter of the first vertical hole (68*a*) is constant from the upper end to the lower end. The diameter of the first vertical hole (68*a*) is equal to the diameter of the fifth hole (81) of the intermediate plate (80) and the diameter of the lower end of the first inclined hole (68*b*). The height of the first vertical hole (68*a*) in the up-down direction is substantially ½ of the thickness of the upper cylinder (60). The first vertical hole (68*a*) connects the first inclined hole (68*b*) and the fifth hole (81) of the intermediate plate (80) to each other.

The first inclined hole (68*b*) extends downward from the upper end surface of the upper cylinder (60). The cross-section of the first inclined hole (68*b*) has a circular shape. The diameter of the first inclined hole (68*b*) gradually decreases toward the top. The diameter of the upper end of the first inclined hole (68*b*) is equal to the diameter of the third hole (42) of the front head (40). The diameter of the upper end of the first inclined hole (68*b*) is larger than the diameter of the first vertical hole (68*a*). The height of the first inclined hole (68*b*) in the up-down direction is substantially ½ of the thickness of the upper cylinder (60). The first inclined hole (68*b*) connects the first vertical hole (68*a*) and the third hole (42) of the front head (40) to each other.

Lower Cylinder

A second inclined hole (78*b*) is formed in the lower cylinder (70). The second inclined hole (78*b*) passes through the lower cylinder (70) in the thickness direction (up-down direction). The second inclined hole (78*b*) extends from the upper end toward the lower end of the lower cylinder (70). The cross-section of the second inclined hole (78*b*) has a circular shape. The diameter of the second inclined hole (78*b*) gradually decreases toward the bottom. In other words, the diameter of the upper end of the second inclined hole (78*b*) is larger than the diameter of the lower end of the second inclined hole (78*b*). The diameter of the upper end of the second inclined hole (78*b*) is equal to the diameter of the third hole (42) of the intermediate plate (80). The diameter of the lower end of the second inclined hole (78*b*) is equal to the diameter of the fourth hole (52) of the rear head (50). The second inclined hole (78*b*) connects the third hole (42) of the intermediate plate (80) and the fourth hole (52) of the rear head (50) to each other.

Discharge Passage

The inflow passage (I) and the outflow passage (O) in the present embodiment each have a first passage (P1) and a second passage (P2). The inflow passage (I) is constituted by the fourth hole (52) of the rear head (50) and the second inclined hole (78*b*) of the lower cylinder (70). In other words, the inflow passage (I) is formed across the two members of the rear head (50) and the lower cylinder (70).

The first passage (P1) of the inflow passage (I) is the fourth hole (52) of the rear head (50). The second passage (P2) of the inflow passage (I) is the second inclined hole (78*b*) of the lower cylinder (70). The second inclined hole (78*b*) of the lower cylinder (70) connects the fourth hole (52) of the rear head (50) and the fifth hole (81) of the intermediate plate (80) to each other. The passage sectional area of the second inclined hole (78*b*) gradually increases toward the fifth hole (81) of the intermediate plate (80).

The muffling chamber (M) is constituted by the fifth hole (81) of the intermediate plate (80) and the first vertical hole (68*a*) of the upper cylinder (60). In other words, the muffling chamber (M) is formed across the two members of the intermediate plate (80) and the upper cylinder (60). The muffling chamber (M) includes the plurality of expansion chambers (E). The expansion chamber (E) is formed in each of the fifth hole (81) of the intermediate plate (80) and the first vertical hole (68*a*) of the upper cylinder (60). In the present embodiment, the upper cylinder (60) and the intermediate plate (80) correspond to the first member.

The outflow passage (O) is constituted by the first inclined hole (68*b*) of the upper cylinder (60) and the third hole (42) of the front head (40). In other words, the outflow passage (O) is formed across the two members of the upper cylinder (60) and the front head (40).

The first passage (P1) of the outflow passage (O) is the third hole (42) of the front head (40). The second passage (P2) of the outflow passage (O) is the first inclined hole (68*b*) of the upper cylinder (60). The first inclined hole (68*b*) of the upper cylinder (60) connects the third hole (42) of the front head (40) and the first vertical hole (68*a*) of the upper cylinder (60) to each other. The passage sectional area of the first inclined hole (68*b*) gradually increases toward the fifth hole (81) of the intermediate plate (80).

The outflow end of the inflow passage (I) is in communication with the inflow end of the muffling chamber (M). In other words, the outflow end of the inflow passage (I) is in communication with the inflow end of the fifth hole (81) of the intermediate plate (80). The inflow end of the outflow passage (O) is in communication with the outflow end of the muffling chamber (M). In other words, the inflow end of the outflow passage (O) is in communication with the outflow end of the first vertical hole (68*a*) of the upper cylinder (60).

The passage sectional area of the expansion chambers (E) is larger than the passage sectional areas of the inflow passage (I) and the outflow passage (O). To be specific, the passage sectional areas of each of the fifth hole (81) of the intermediate plate (80) and the first vertical hole (68*a*) of the upper cylinder (60) is larger than the flow-path sectional area of each of the fourth hole (52) of the rear head (50) and the lower end of the second inclined hole (78*b*) of the lower cylinder (70). The passage sectional area of each of the fifth hole (81) of the intermediate plate (80) and the first vertical hole (68*a*) of the upper cylinder (60) is larger than the passage sectional area of each of the third hole (42) of the front head (40) and the upper end of the first inclined hole (68*b*) of the upper cylinder (60).

Feature (1) of Embodiment 3

In the compressor (1) of the present embodiment, the inflow passage (I) and the outflow passage (O) both have the first passage (P1) and the second passage (P2) that connects the first passage (P1) and the muffling chamber (M) to each other. The passage sectional area of the second passage (P2) gradually increases toward the muffling chamber (M).

Here, when the passage section of the discharge passage (P) of the compression mechanism (100) includes a portion whose passage sectional area rapidly increases, an eddy of a gas refrigerant is generated at the rapidly increasing portion. Due to this eddy, the kinetic energy of the gas refrigerant is lost, and the compression power is decreased.

In the compressor (1) of the present embodiment, the passage sectional area of the second passage of each of the inflow passage (I) and the outflow passage (O) gradually increases toward the muffling chamber (M), and thus, the passage sectional area does not rapidly increase at parts where the inflow passage (I) and the outflow passage (O) are connected to the muffling chamber (M). Consequently, according to the present embodiment, it is possible to reduce the loss of compression power.

Embodiment 4

Embodiment 4 will be described. The compressor (1) of the present embodiment is the compressor (1) of Embodiment 1 in which the configurations of the upper cylinder (60) and the lower cylinder (70) of the compression mechanism (100) are changed. Here, regarding the upper cylinder (60) and the lower cylinder (70) of the present embodiment, features that differ from those in Embodiment 1 will be described.

Compression Mechanism

Upper Cylinder

Figure 7:
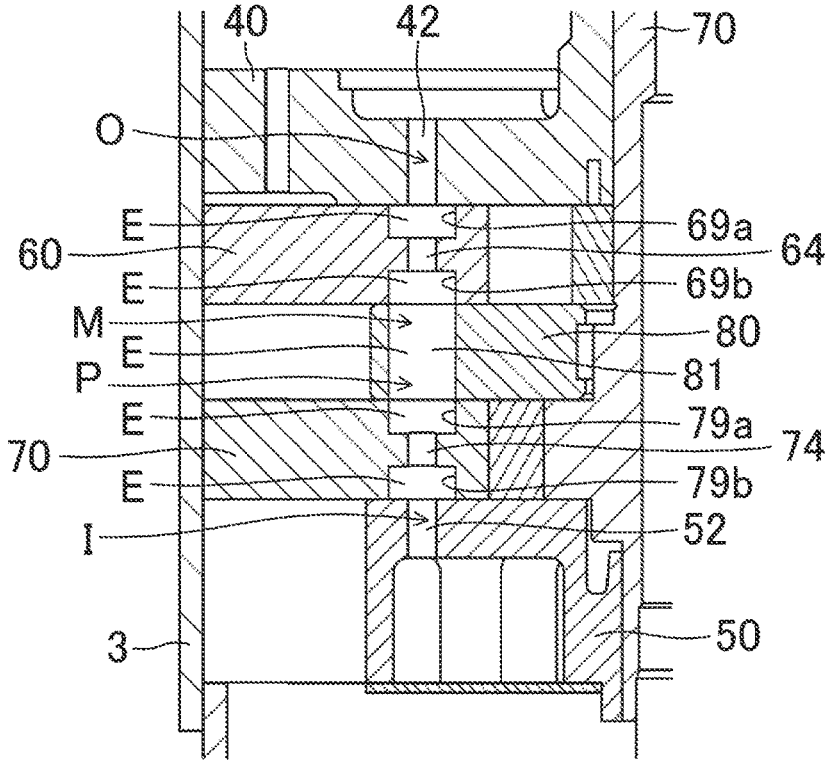
FIG. 7 is a view corresponding to FIG. 2 according to Embodiment 4.

As illustrated in FIG. 7, a third recessed portion (69*a*), a fourth recessed portion (69*b*), and the first hole (64) are formed in the upper cylinder (60). The third recessed portion (69*a*), the first hole (64), and the fourth recessed portion (69*b*) are formed in the upper cylinder (60) in this order from top to bottom. The internal space of the third recessed portion (69*a*), the first hole (64), and the internal space of the fourth recessed portion (69*b*) are continuous with each other. Specifically, the lower end of the third recessed portion (69*a*) and the upper end of the first hole (64) are connected to each other. The lower end of the first hole (64) and the upper end of the fourth recessed portion (69*b*) are connected to each other. The third recessed portion (69*a*), the first hole (64), and the fourth recessed portion (69*b*) pass through the upper cylinder (60) in the thickness direction (up-down direction).

The third recessed portion (69*a*) extends downward from the upper end surface of the upper cylinder (60). The cross-section of the third recessed portion (69*a*) has a circular shape. The inner diameter of the third recessed portion (69*a*) is constant from the upper end to the lower end. The inner diameter of the third recessed portion (69*a*) is equal to the diameter of the fifth hole (81) of the intermediate plate (80). The height of the third recessed portion (69*a*) in the up-down direction is substantially ⅓ of the thickness of the upper cylinder (60). The internal space of the third recessed portion (69*a*) connects the first hole (64) and the third hole (42) of the front head (40) to each other.

The fourth recessed portion (69*b*) extends upward from the lower end surface of the upper cylinder (60). The cross-section of the fourth recessed portion (69*b*) has a circular shape. The inner diameter of the fourth recessed portion (69*b*) is constant from the upper end to the lower end. The inner diameter of the fourth recessed portion (69*b*) is equal to the diameter of the fifth hole (81) of the intermediate plate (80). The height of the fourth recessed portion (69*b*) in the up-down direction is substantially ⅓ of the thickness of the upper cylinder (60). The internal space of the fourth recessed portion (69*b*) connects the first hole (64) and the fifth hole (81) of the intermediate plate (80) to each other.

The first hole (64) is formed between the third recessed portion (69*a*) and the fourth recessed portion (69*b*). The cross-section of the first hole (64) has a circular shape. The diameter of the first hole (64) is constant from the upper end to the lower end. The diameter of the first hole (64) is equal to the diameter of the third hole (42) of the front head (40). The diameter of the first hole (64) is smaller than the inner diameters of the third recessed portion (69*a*) and the fourth recessed portion (69*b*). The height of the first hole (64) in the up-down direction is substantially ⅓ of the thickness of the upper cylinder (60). The first hole (64) connects the internal space of the third recessed portion (69*a*) and the internal space of the fourth recessed portion (69*b*) to each other.

Lower Cylinder

A fifth recessed portion (79*a*), a sixth recessed portion (79*b*), and the second hole (74) are formed in the lower cylinder (70). The fifth recessed portion (79*a*), the second hole (74), and the sixth recessed portion (79*b*) are formed in the lower cylinder (70) in this order from top to bottom. The internal space of the fifth recessed portion (79*a*), the second hole (74), and the internal space of the sixth recessed portion (79*b*) are continuous with each other. Specifically, the lower end of the fifth recessed portion (79*a*) and the upper end of the second hole (74) are connected to each other. The lower end of the second hole (74) and the upper end of the sixth recessed portion (79*b*) are connected to each other. The fifth recessed portion (79*a*), the second hole (74), and the sixth recessed portion (79*b*) pass through the lower cylinder (70) in the thickness direction (up-down direction).

The fifth recessed portion (79*a*) extends downward from the upper end surface of the lower cylinder (70). The cross-section of the fifth recessed portion (79*a*) has a circular shape. The inner diameter of the fifth recessed portion (79*a*) is constant from the upper end to the lower end. The inner diameter of the fifth recessed portion (79*a*) is equal to the diameter of the fifth hole (81) of the intermediate plate (80). The height of the fifth recessed portion (79*a*) in the up-down direction is substantially ⅓ of the thickness of the lower cylinder (70). The internal space of the fifth recessed portion (79*a*) connects the second hole (74) and the fourth hole (52) of the rear head (50) to each other.

The sixth recessed portion (79*b*) extends upward from the lower end surface of the lower cylinder (70). The cross-section of the sixth recessed portion (79*b*) has a circular shape. The inner diameter of the sixth recessed portion (79*b*) is constant from the upper end to the lower end. The inner diameter of the sixth recessed portion (79*b*) is equal to the diameter of the fifth hole (81) of the intermediate plate (80). The height of the sixth recessed portion (79*b*) in the up-down direction is substantially ⅓ of the thickness of the lower cylinder (70). The internal space of the sixth recessed portion (79*b*) connects the second hole (74) and the fifth hole (81) of the intermediate plate (80) to each other.

The second hole (74) is formed between the fifth recessed portion (79*a*) and the sixth recessed portion (79*b*). The cross-section of the second hole (74) has a circular shape. The diameter of the second hole (74) is constant from the upper end to the lower end. The diameter of the second hole (74) is equal to the diameter of the fourth hole (52) of the rear head (50). The diameter of the second hole (74) is smaller than the inner diameters of the fifth recessed portion (79*a*) and the sixth recessed portion (79*b*). The height of the second hole (74) in the up-down direction is substantially ⅓ of the thickness of the lower cylinder (70). The second hole (74) connects the internal space of the fifth recessed portion (79*a*) and the internal space of the sixth recessed portion (79*b*) to each other.

Discharge Passage

The inflow passage (I) in the present embodiment is constituted by the internal space of the fourth hole (52) of the rear head (50).

The muffling chamber (M) is constituted by the internal space of the third recessed portion (69*a*) of the upper cylinder (60), the first hole (64), the internal space of the fourth recessed portion (69*b*), the fifth hole (81) of the intermediate plate (80), the internal space of the fifth recessed portion (79*a*) of the lower cylinder (70), the second hole (74), and the internal space of the sixth recessed portion (79*b*). In other words, the muffling chamber (M) is formed across the three members of the upper cylinder (60), the intermediate plate (80), and the lower cylinder (70). The muffling chamber (M) includes the plurality of expansion chambers (E). The expansion chambers (E) are formed in the internal space of each of the third recessed portion (69*a*) and the fourth recessed portion (69*b*) of the upper cylinder (60), the fifth hole (81) of the intermediate plate (80), and the internal space of each of the fifth recessed portion (79*a*) and the sixth recessed portion (79*b*) of the lower cylinder (70).

The outflow passage (O) is constituted by the third hole (42) of the front head (40). The outflow end of the inflow passage (I) is in communication with the inflow end of the muffling chamber (M). In other words, the outflow end of the inflow passage (I) is in communication with the lower open end of the sixth recessed portion (79*b*) of the lower cylinder (70). The inflow end of the outflow passage (O) is in communication with the outflow end of the muffling chamber (M). In other words, the inflow end of the outflow passage (O) is in communication with the upper open end of the third recessed portion (69*a*) of the upper cylinder (60).

The passage sectional area of the expansion chambers (E) is larger than the passage sectional areas of the inflow passage (I) and the outflow passage. To be specific, the passage sectional area of each of the third recessed portion (69*a*) and the fourth recessed portion (69*b*) of the upper cylinder (60), the fifth hole (81) of the intermediate plate (80), and the fifth recessed portion (79*a*) and the sixth recessed portion (79*b*) of the lower cylinder (70) is larger than the passage sectional area of each of the fourth hole (52) of the rear head (50) and the third hole (42) of the front head (40).

Other Embodiments

The aforementioned embodiments may be configured as follows.

The compressor (1) of each of the aforementioned embodiments may be of a semi-hermetic type or an open type.

The drive mechanism (10) of each of the aforementioned embodiments may have a structure other than the electric motor (20) and the drive shaft (30). For example, the drive mechanism may be an expansion mechanism that converts power generated when a refrigerant expands into rotational power of the compression mechanism (100), or a transmission mechanism that transmits power of another rotating body to the compression mechanism (100) via a belt or the like.

The discharge passage (P), which is formed in the compression mechanism (100) of the rotary compressor, of each of the aforementioned embodiments may be formed in a compression mechanism of a scroll compressor. Specifically, the compression mechanism (100) has a fixed scroll and a housing.

The fixed scroll and the housing are the plurality of members and are the first member. The fixed scroll and the housing are disposed to overlap each other. Part of the muffling chamber (M) is formed in the fixed scroll acid the housing. The muffling chamber (M) formed in the fixed scroll and the muffling chamber (M) formed in the housing are in communication with each other. In other words, the muffling chamber (M) is formed across the two members of the fixed scroll and the housing. The inflow passage (I) connected to the inflow end of the muffling chamber (M) is formed in the fixed scroll. The outflow passage (O) connected to the outflow end of the muffling chamber (M) is formed in the housing. The inflow passage (I), the muffling chamber (M), and the outflow passage (O) are formed to be continuous with each other in a direction in which the fixed scroll and the housing overlap each other.

The expansion chamber (E) is formed in each of the fixed scroll and the housing. The passage sectional area of the expansion chamber (E) formed in each of the fixed scroll and the housing is larger than the passage sectional areas of the inflow passage (I) formed in the fixed scroll and the outflow passage (O) formed in the housing. The muffling chamber (M) is formed across the fixed scroll and the housing so as to include the expansion chamber (E) of the fixed scroll and the expansion chamber (E) of the housing.

The compression mechanism (100) of each of the aforementioned embodiments may have a configuration including one each of the front head (40), the rear head (50), the cylinder (60), and the piston (62).

The intermediate plate (80) of each of the aforementioned embodiments may be formed by a plurality of plates.

In the compression mechanism (100) of each of the aforementioned embodiments, a recessed portion may be formed in one or both of the front head (40) and the rear head (50). In this case, the front head (40) and the rear head (50) in which the recessed portions are formed correspond to the third member.

In the discharge passage (P) of each of the aforementioned embodiments, the expansion chamber (E) may be formed in one or both of the front head (40) and the rear head (50). In this case, the front head (40) and the rear head (50) in which the expansion chambers (E) are formed correspond to the first member.

A plurality of the structures of the discharge passage (P) of the aforementioned embodiments may be combined together.

In the discharge passage (P) of Embodiment 2 described above, the auxiliary muffling chamber (S) may be formed in the front head (40). Specifically, the first hole and the annular space may be formed in the front head (40). In this case, the front head (40) corresponds to the second member.

The second passage (P2) of Embodiment 3 described above may be present in one of the inflow passage (I) and the outflow passage (O).

Although embodiments and modifications have been described above, it should be understood that various changes in the forms and the details are possible without departing from the gist and the scope of the claims. The embodiments and the modifications above may be combined and replaced, as appropriate, as long as the directed functions of the present disclosure are not lost.

As described above, the present disclosure is useful for a compressor.

The invention claimed is:

1. A compressor comprising:

a drive mechanism including a drive shaft that extends in an axial direction; and a compression mechanism configured to be driven by the drive mechanism, the compression mechanism having a discharge passage in which a refrigerant compressed in the compression mechanism flows, and a plurality of members disposed to overlap each other, the discharge passage including a muffling, chamber, an inflow passage connected to an inflow end of the muffling chamber, and an outflow passage connected to an outflow end of the muffling chamber, and the muffling chamber being formed across two or more members of the plurality of members, the plurality of members including a first cylinder having a first end and a second end spaced apart along the axial direction, a second cylinder having a first end and a second end spaced apart along the axial direction, and an intermediate closing member that is disposed between the second end of the first cylinder and the first end of the second cylinder, the intermediate closing member covering an opening surface at the second end of the first cylinder and an opening surface at the first end of the second cylinder, the inflow passage, the muffling chamber, and the outflow passage being formed to be continuous with each other in a direction in which the plurality of members overlap each other, the muffling chamber including an expansion chamber having a passage sectional area larger than passage sectional areas of the inflow passage and the outflow passage, the expansion chamber being formed across the intermediate closing member, the first cylinder, and the second cylinder, the intermediate closing member having a hole that passes through the intermediate closing member in the axial direction, the first cylinder having a first recessed portion formed at an end surface of the second end of the first cylinder, the first recessed portion being in communication with the hole of the intermediate closing member, and a first hole in communication with the first recessed portion and the outflow passage, the second cylinder having a second recessed portion formed at an end surface of the first end of the second cylinder, the second recessed portion being in communication with the hole of the intermediate closing member, and a second hole in communication with the second recessed portion and the inflow passage, the expansion chamber being formed by the hole of the intermediate closing member, an internal space of the first recessed portion, and an internal space of the second recessed portion, the hole of the intermediate closing member, the first recessed portion, and the second recessed portion having diameters that are identical to each other, and the inflow passage, the outflow passage, the first hole of the first cylinder, the second hole of the second cylinder, and the expansion chamber being formed to be coaxial with each other.

2. The compressor according to claim 1, wherein the plurality of members further include a first closing member that covers an opening surface at the first end of the first cylinder, and a second closing member that covers an opening surface at the second end of the second cylinder.

* * * * *